United States Patent [19]

Schneider

[11] Patent Number: 4,822,329

[45] Date of Patent: Apr. 18, 1989

[54] COMBINATION FOLDING AND CROSS-PERFORATING SYSTEM

[75] Inventor: Eckhard Schneider, Stadtbergen, Fed. Rep. of Germany

[73] Assignee: MAN Roland Druckmaschinen AG, Offenbach am Main, Fed. Rep. of Germany

[21] Appl. No.: 111,012

[22] Filed: Oct. 20, 1987

[30] Foreign Application Priority Data

Oct. 24, 1986 [DE] Fed. Rep. of Germany ..... 3636246

[51] Int. Cl.[4] ..... B65H 35/08; B65H 45/16; B65H 45/28

[52] U.S. Cl. ..... 493/359; 493/353

[58] Field of Search ..... 493/353, 359, 370, 416, 493/417, 425, 426, 454, 363, 468, 471

[56] References Cited

U.S. PATENT DOCUMENTS

| | | | |
|---|---|---|---|
| 536,037 | 3/1895 | Mehnert | 493/353 |
| 632,115 | 8/1899 | Hicks | 493/359 |
| 1,171,920 | 2/1916 | Barber . | |
| 2,353,445 | 7/1944 | Crafts | 493/359 |
| 4,564,183 | 1/1986 | Müller | 493/368 |

FOREIGN PATENT DOCUMENTS

| | | |
|---|---|---|
| 223328 | 8/1909 | Fed. Rep. of Germany . |
| 1932241 | 12/1965 | Fed. Rep. of Germany . |

*Primary Examiner*—Frederick R. Schmidt
*Assistant Examiner*—Jack W. Lavinder
*Attorney, Agent, or Firm*—Frishauf, Holtz, Goodman & Woodward

[57] ABSTRACT

To permit formation of a transverse perforation in advance of a second cross fold, a first folding blade cylinder (5) equipped with needles (6) and preferably forming a collection cylinder has folding blades, to receive products, cooperation with a first folding flap cylinder (8). In accordance with the invention, the folding flap cylinder is formed with at least one axially extended perforating groove (10) and an associated folding and perforating blade cylinder (11) has a combination perforating and folding blade (13) which engages a folded product once to push the folded product into the perforating groove (10) to form perforations and, upon further travel of the folded product, transfers the product to a second folding flap cylinder (14) having folding flaps (16) to again engage the products with the combination perforating and folding blade to form a second transverse fold in the folding flaps of the second folding flap cylinder (14). Selective control permits enabling or disabling the combination perforating and folding blade (13), for transferring, for example, sheets directly to grippers (15) on the second folding flap cylinder (14), if no second transverse fold is to be made.

6 Claims, 1 Drawing Sheet

FIG. 2
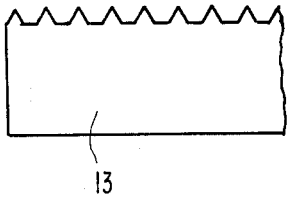
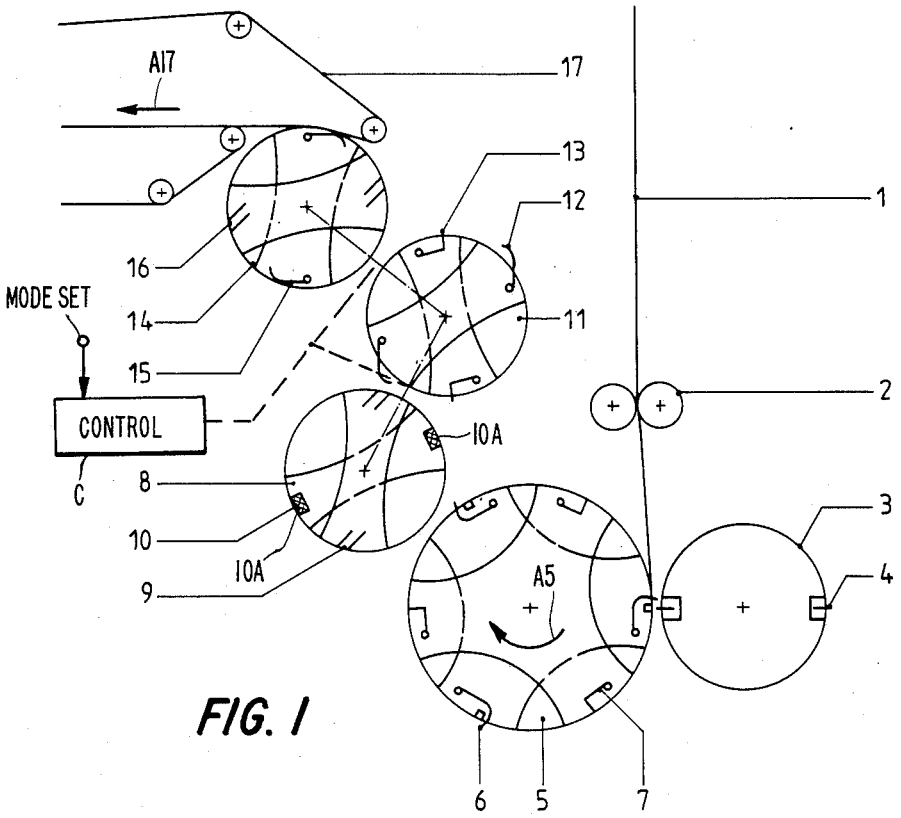
FIG. 1

COMBINATION FOLDING AND CROSS-PERFORATING SYSTEM

REFERENCE TO RELATED PUBLICATION

German utility model 1932241

Reference to related application, assigned to the assignee of the present invention, the disclosure of which is hereby incorporated by reference: U.S. Ser. No. 07/111042, filed Oct. 20, 1987, Schneider.

The present invention relates to substrate handling systems and apparatus, and more particularly to apparatus to receive a web of paper from a printing machine, to sever the web, and form transverse perforations at the back of a fold of folded products which will result from the folding operations, in which the perforation is applied in advance of a second folding.

BACKGROUND

It has previously been proposed to provide transverse perforations in a folding apparatus, in which the perforations are applied in advance of the folding of a sheet. A folding blade or knife is formed with perforation teeth. A collection cylinder is provided, having a counter roller with a perforating groove. The structure requires an additional counter roller which requires space and is costly to install. Perforating is possible only at the actual fold or crease line of the first transfer fold.

THE INVENTION

It is an object to provide the combined folding and perforating apparatus, in which respective layers of the fold products are perforated together and combined in advance of a second transfer fold, without requiring separate rollers, cylinders or the like.

Briefly, a folding blade cylinder is formed with combined folding and perforating blades. It is associated with a folding cylinder which, besides having folding flaps to received folded edges into which a product can be pushed by the perforating and folding blade, is formed additionally with a perforating groove, so that, upon twice operating the combined folding and perforating blade with respect to any one product—which may be a sheet or a plurality of sheets—a perforation can be readily provided to the products which, then, are folded again and, for example, in a second folding flap cylinder to form a second fold.

The structure and system have the advantage that the layers of the products in the second transfer fold are interengaged by the common perforations. This is of specific advantage if the folded products, for example, are to be formed or joined at sections of the book which, later on, are applied to an adhesion apparatus, where the adhesive can penetrate through the perforation. This type of transverse or cross-perforation is, additionally, of advantage if the web which is supplied cannot be combined in a folding form, or folding triangle. Generally known folding apparatus, are usually operated such that the transverse perforations, the first as well as for the second fold, were applied on the running web, that is, on the incoming traveling web. This has some disadvantages, particularly with respect to accuracy in further handling.

DRAWINGS

FIG. 1 shows the system and apparatus of the present invention in a highly schematic representation, where the components themselves are standard in the industry.

FIG. 2 shows a suitable combination perforating and folding blade 13, as it is known from the state of the art.

DETAILED DESCRIPTION

A substrate web system, which may be a single discrete substrate web or a plurality of adjacent superposed substrate webs 1, is supplied from a supply, for example the output of a printing machine system. The substrate web system, is guided through a pair of pulling rollers 2 to a folding blade cylinder 5 which included puncturing needles. The folding blade cylinder 5 has puncturing needle 6 and folding blades 7 thereon. Prior to application to cylinder 5, the web system 1 is cut by cutting knives 4 on a cutting cylinder 3, to cut the web system to form the desired products, of the suitable length. This is a well known and standard procedure. The cut products are transported by the needles 6 of the needle and folding blade cylinder 5 about the portion of the circumference of the folding blade cylinder 5. The folding blades 7 on the folding blade cylinder 5 push the products into folding flaps 9 of a folding flap cylinder 8, to form a first transfers or cross fold. The folding flap cylinder 8 is simple and of standard construction except that, in accordance with the feature of the invention, it is formed with one or more axially extending perforating grooves 10, which are filled with a ledge 10A of elastic material as rubber or the like.

A gripper and folding and perforating blade cylinder 11 is located downstream of the folding flap cylinder 8. Cylinder 11 has grippers 12 and folding blades 13, shown more detailed in FIG. 2. The once cross-folded products are gripped by the grippers 12 from the folding flap cylinder 8 and transferred to the cylinder 11.

In accordance with the feature of the invention, a cross perforation is formed in the products which are located on cylinder 11, typically at the crease or fold to be formed subsequently at the second cross fold, by controlling the folding blades 13, which are formed in accordance with a feature of the invention, as combination perforating and folding blades, to engage against the perforating grooves 10 of the folding flap cylinder 8. A control unit C, which has a mode-set input, controls the operation of the respective perforation and folding blades. This can be done, mechanically, easily and as well known, by suitably controlling the operation of cams in the rotating cylinder. The control unit C is shown only schematically and, itself, may include a cam gear control for suitable operation of the combination perforating and folding blades 13.

OPERATION

By controlling the combination perforating and folding blades 13 of the folding and perforating blade cylinder 11 against the elastic ledge 10A within the perforating groove 10 of the folding flap cylinder 8, the products which are located on the folding and perforating blade cylinder 11 will be perforated. Subsequently, the folded products, which are gripped by the grippers 12 on the cylinder 11 are transferred to a second folding flap and gripper cylinder 14. The combination perforating and folding blades 13 then form a second cross fold by engaging the products which are on the cylinder 11 and pushing them into folding flaps 16 of the gripper and folding flap cylinder 14. This forms the second cross fold. After formation of the second cross fold, the cylinder 14 delivers the now twice folded and perforated products to a delivery transport system, for example a belt system 17.

For a web running downwardly—with respect to FIG. 1, cylinder 5 rotates in the direction of arrow A5, and the delivery direction is shown by the arrow A17.

The system has the advantage of being extremely versatile, since different modes of operation can be obtained thereby, in accordance with control of the control unit which, in turn, suitably controls the operation of the respective grippers and folding blades.

Further production possibility can be obtained, for example, by transfering the products which were once transversely folded from the cylinder 5 to the cylinder 8, and then transfering them directly to the grippers 15 of the gripper and folding flap cylinder 14 by the grippers 12 of the folding blade cylinder 11. In this mode of operation, the combination perforating and folding blade 13 on cylinder 11, as well as the folding flaps 16 on cylinder 14 are not used. In this mode of operation, the system operates without forming a second cross fold, or without forming a perforation between the cylinders 8 and 11, by suitably controlling, via the control unit C, the combination perforating and folding blade 13 so that it will not push the products against the perforating groove 10. The simple rotation of a roller cam, so as to present to cam followers on the folding blades a raised, or a smooth circumference when the folding blades travel to a position opposite the grooves 10 enables or disables the formation of the perforation.

Preferably, the needle and folding blade cylinder 5 may be formed as a collection cylinder in order to collect a plurality of products in advance of the formation of the first cross fold, and to then form the cross fold conjointly, together of all the collected products. The grippers 15 on the second gripper and folding flap cylinder 14 can be placed out of operation by control from the Control unit C. When the second cross fold is made by engaging the perforating and folding blade 13 into the folding flaps 16 of cylinder 14, the folding flaps 16 can than hold the products. When the folding blade 13 is disabled, so that no second cross fold is made, the folding flaps 16 on the cylinder 14 will not have any function and will be out of operation.

The combination perforating and folding blade 13 may use a construction, well known in the industry, as shown for example, by the German utility model No. 19 32 241. As there shown, the combination perforating and folding blade is formed with perforation teeth.

The perforating groove 10 in cylinder 8 is filled with a ledge or strip 10A of elastic material and positioned to permit the combination perforating and folding blade 13 to perforate products on the cylinder 8 as the groove 10 passes opposite the blade 13 on the cylinder 11.

I claim:

1. A combination folding and cross perforating system for crosswise, or transversely pre-perforating a product at a location where a folded back or crease in a folded product is to be produced, comprising a folding blade cylinder (5) equipped with needles (6) and folding blades (7), for receiving products;

a first folding flap cylinder (8) having folding flaps (9) for receiving products from said folding blade cylinder (5), and at least one axially extending perforating groove (10);

a folding and perforating blade cylinder (11) associated with said first folding flap cylinder (8), said folding and perforating blade cylinder having grippers 12 for receiving the folded products thereon from said first folding flap cylinder (8) and a combination perforating and folding blade (13), said combination perforating and folding blade being controllable to engage a folded product held on the folding and perforating blade cylinder (11) when said folded product moves above the perforating groove (10) of the first folding flap cylinder (8) to form transverse perforations in the folded products;

a second folding flap cylinder (14) having folding flaps (16) thereon, said second folding flap cylinder (14) being associated with the folding and perforating blade cylinder (11) and receiving products from said folding and perforating blade cylinder (11), said combination perforating and folding blade (13) being controllable to engage said products when the products move over the folding flaps (16) of the second folding flap cylinder (14) to form a second transverse fold in the perforated products, said second folding flap cylinder (14) delivering the products to a delivery transport system (17).

2. The system of claim 1, wherein the first folding blade cylinder (5) comprises a collection cylinder.

3. The system of claim 1 wherein the second folding flap cylinder (14) includes grippers (15) which can be disabled upon formation of the second transverse or cross fold.

4. The system of claim 3 wherein the grippers of the second folding flap cylinder are controllable to receive the folded products having the first transverse cross fold therein from the folding blade and perforating cylinder (11);

and control means (C) coupled to the combination perforating and folding blades (13) on the folding and perforating blade cylinder (11) disabling operation of the combination perforating and folding blades (13) and disabling operation of the folding flaps (16) of the second folding flap cylinder (14).

5. The system of claim 4, wherein the first folding blade cylinder (5) comprises a collection cylinder.

6. The system of claim 3, wherein the first folding blade cylinder (5) comprises a collection cylinder.

* * * * *